United States Patent [19]

Barrett

[11] Patent Number: 4,520,585

[45] Date of Patent: Jun. 4, 1985

[54] PISTOL MAGAZINE LOADING GUIDE

[76] Inventor: Timothy M. Barrett, 1131 W. Duarte, No. 6, Arcadia, Calif. 91006

[21] Appl. No.: 567,064

[22] Filed: Dec. 30, 1983

[51] Int. Cl.[3] ..... F41C 25/06

[52] U.S. Cl. ..... 42/7

[58] Field of Search ..... 42/7, 90, 71 P

[56] References Cited

U.S. PATENT DOCUMENTS

| | | | |
|---|---|---|---|
| 900,865 | 10/1908 | Louis | 42/7 |
| 1,410,266 | 3/1922 | Pedersen | 42/7 |
| 3,999,321 | 12/1976 | Musgrave | 42/7 |

*Primary Examiner*—Charles T. Jordan

*Attorney, Agent, or Firm*—Charles H. Thomas

[57] ABSTRACT

A pistol which is loaded through a magazine receiving opening in the butt of the frame of the pistol handle is provided with an improved loading guide. The guide is equipped with a funnel which aids in guiding a magazine into the magazine receiving opening. The guide embraces the walls of the pistol frame and defines transverse openings on its opposite sides arranged in coaxial alignment with the magazine spring housing pin bores in the pistol frame. A mounting rod is engaged with the guide through the transverse openings therein and passes through the magazine spring housing pin bores to both secure the guide to the pistol frame and to function as a magazine spring housing pin.

18 Claims, 11 Drawing Figures

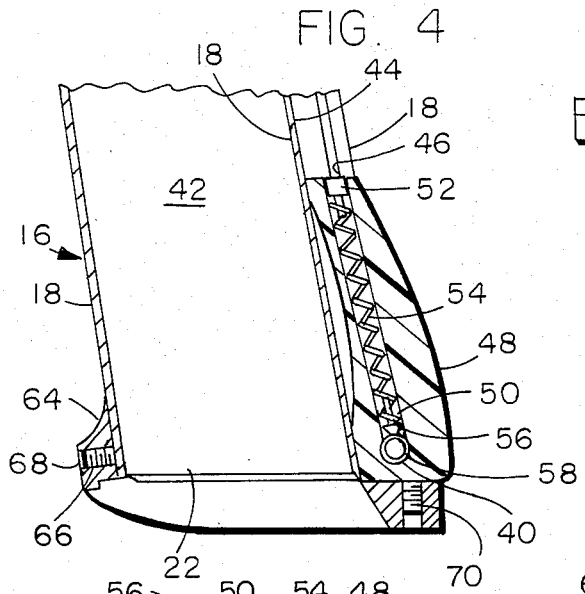
FIG. 4
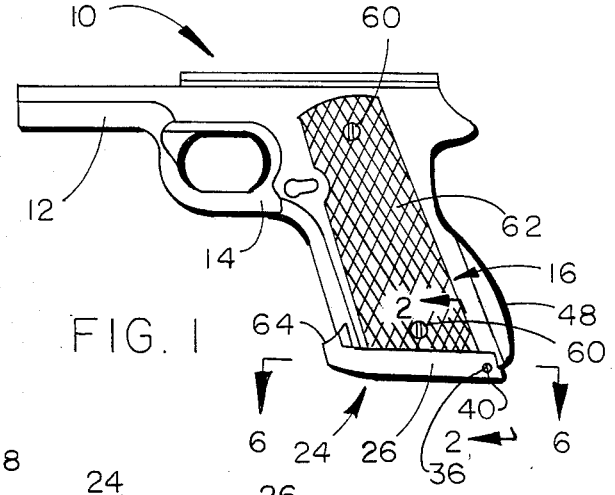
FIG. 1
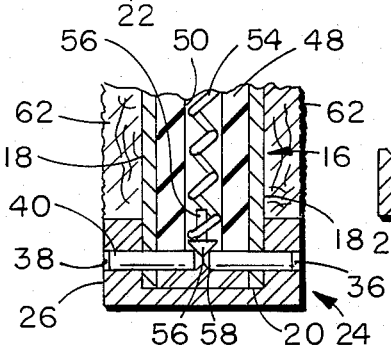
FIG. 2
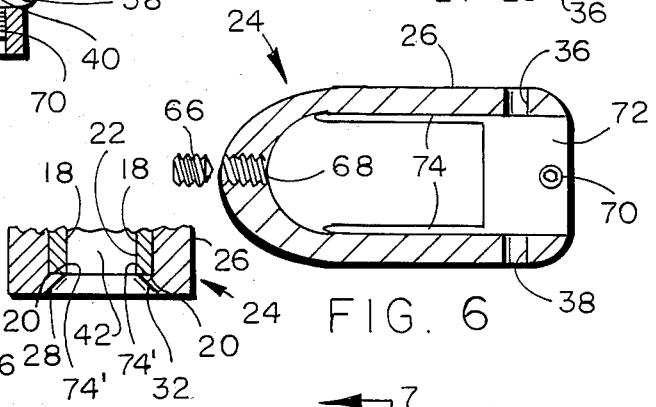
FIG. 6
FIG. 8
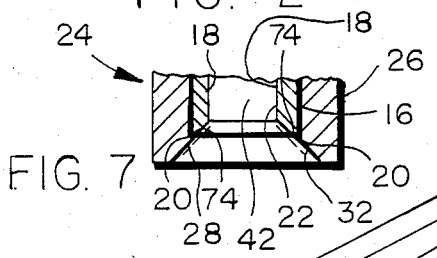
FIG. 7
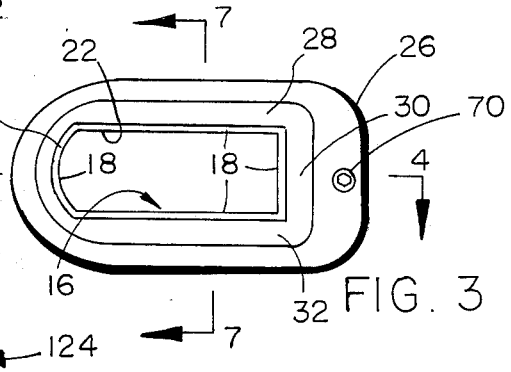
FIG. 3
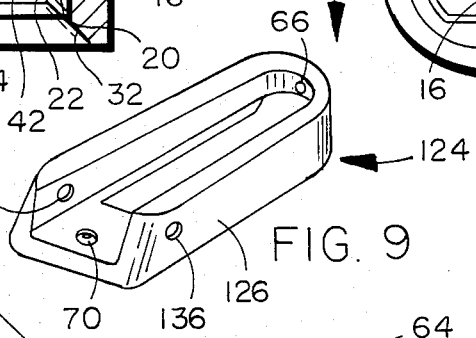
FIG. 9
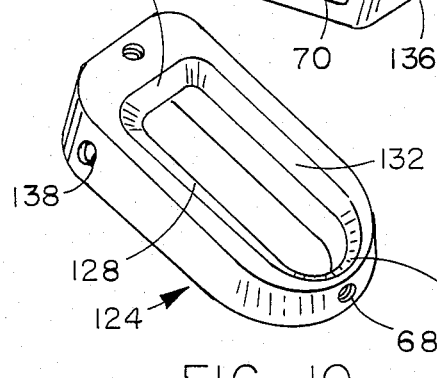
FIG. 10
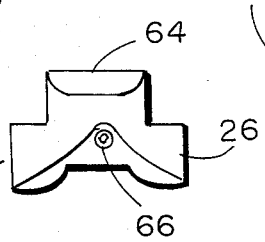
FIG. 5
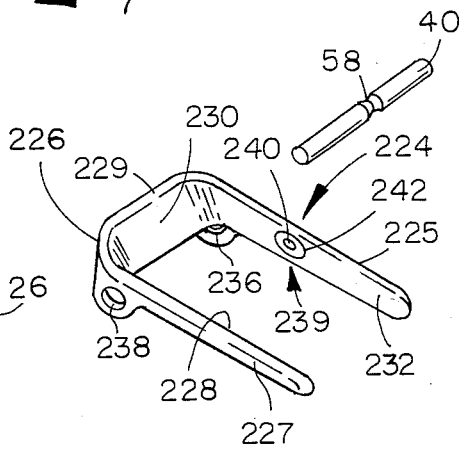
FIG. 11

PISTOL MAGAZINE LOADING GUIDE

BACKGROUND OF THE INVENTION

1. Field of the Invention

The present invention relates to magazine loading aids for use with pistols which are loaded with a magazine through a magazine receiving opening in the butt of the pistol frame.

2. Description of the Prior Art

The great majority of automatic and semi-automatic pistols which are currently manufactured fire rounds of ammunition from a magazine which carries a plurality of ammunition rounds. The magazine is a metal case, usually elongated and enclosed on all sides with an opening at the top into which rounds of ammunition are inserted and from which the ammunition rounds are fed into the chamber of the pistol. A spring at the bottom of the magazine forces the rounds of ammunition upward toward the opening.

Most magazines for automatic pistols slide into a cavity in the pistol frame through a magazine receiving opening in the butt of the handle of the pistol frame. Widely used standard pistols of this type include the 1911 and 1911 A-1 Colt Browning U.S. Government Model .45 caliber semi-automatic recoil operated pistols. These pistols have been manufactured and in use since the early part of this century. The Colt Browning 1911 A-1 .45 caliber automatic pistol is manufactured by numerous arms manufacturers throughout the world. Colt Firearms manufactures the Gold Cup, Series 70 Mark IV, and Commander Series Colt .45 caliber automatic pistols. Other manufacturers include Llama, EMC (Michigan Armament), Essex, Crown City, Datenics and Ithica. Another form of the Colt Browning 1911 A-1 .45 caliber automatic pistol is sold as the Argentine Ballester Milina M 1927 .45 automatic pistol.

Although the Colt Browning 1911 A-1 .45 caliber automatic pistol is manufactured and sold by a large number of different firearms manufacturers, the details of construction of the pistol and the dimensions thereof are highly standardized.

The magazine for the Colt Browning 1911 A-1 .45 caliber automatic pistol carries seven rounds of ammunition and is squared in the back and rounded in the front. A magazine release mechanism mounted in the frame of the pistol includes a catch that is engageable with a slot defined in the magazine. The magazine is pushed into the cavity in the pistol frame upwardly through a magazine receiving opening in the butt of the handle of the pistol frame.

A channel is defined behind the magazine cavity in the pistol frame to receive a mechanism for driving the pistol hammer forward when the trigger of the pistol is pulled. This mechanism includes a main coil spring which is compressed when the pistol is cocked and which is released when the trigger is pulled. A hard rubber or plastic housing holds the main spring in position and is itself held in position in the channel in the pistol frame by ribs which fit into corresponding grooves in the pistol frame.

The housing for the main spring assembly is termed the main spring housing. The main spring housing is inserted into position by aligning the ribs thereon with the corresponding grooves in the pistol frame and sliding the main spring housing into the channel behind the magazine cavity from the butt of the pistol.

Various arrangement have been devised to aid in loading a magazine into the magazine receiving opening in the butt of the handle of the pistol frame. Most of these aids function as a chute, guide or funnel located at the bottom of the pistol frame. Such guides are equipped with inwardly facing sloping walls which serve to guide a magazine into the magazine receiving opening in the pistol handle. In competitive target shooting speed in loading a magazine is an extremely important factor. The use of a magazine loading guide improves the speed of magazine loading by minimizing the momentary delays that sometimes occur in attempting to align the magazine with the magazine receiving opening in the pistol handle.

One conventional, commercially available magazine loading guide is a U-shaped plastic structure formed with a pair of ears orthogonal to the legs of the guide. Three sloping surfaces are defined on the interior of the legs and back of the U-shaped guide for the purpose of deflecting and guiding a magazine into the magazine receiving opening in the pistol frame. This conventional guide is attached to the pistol frame by apertures in the ears which fit over the lowermost of two pairs of bushings protruding from the pistol frame. These bushings receive screws for attaching wooden or plastic stocks or grips to the sides of the pistol frame. The ears of the conventional, commercially available plastic magazine loading guide fit over the lowermost of the stock screw bushings protruding laterally outwardly from the upright walls of the pistol frame butt. The ears of the magazine loading guide are entrapped by and sandwiched between the pistol frame on the inside and the stocks or grips on the outside of the pistol.

The conventional magazine loading guide of the type described has several distinct disadvantages. Since it is of a U-shaped configuration it is useful in positioning a magazine that is pushed into the magazine receiving opening in the pistol frame butt only from the sides and from the back. There is no sloping surface at the front of the guide to aid in deflecting the magazine into the magazine receiving opening when the magazine arrives at the forward edge of the opening as it is inserted.

Another disadvantage of the commercially available plastic guide is that when it is secured to the pistol butt it prevents removal of the main spring housing unless the stocks on the sides of the pistol frame handle are first removed. It is desirable to remove the main spring housing from the pistol frame fairly frequently in order to clean the components of the main spring assembly and to correct any malfunction in the main spring assembly. However, with the prior commercially available plastic guide, removal of the main spring housing can only be accomplished after removal of the stocks. All four screws must be disengaged from the stock bushings in order to expose the ears of the magazine guide. One of the ears must then be flexed outwardly to clear the structure of the bushing to which it is attached. Very frequently one of the ears of the magazine guide will break off when the plastic structure of the guide is subjected to such flexure. A guide of this conventional design cannot be constructed more sturdily since flexure of the ears is necessary in order to allow the guide to be removed.

A further disadvantage of the conventinal, commercially available magazine loading guide is that because the stocks must be removed for access to the main spring housing, there is a significant likelihood of stripping the threads of the stock bushings or the screws holding the stocks in the bushings. Stripped threads usually result from overtightening of the stock screws during replacement of the stocks. When the stock bushing threads are stripped the old bushing must be drilled out and a new bushing must be tapped and welded in place. Moreover, the stocks themselves are subjected to a much more frequently likelihood of damage by a screwdriver during the frequent engagement and disengagement of the stock screws.

Due to the necessity for removing the stocks for servicing of the main spring assembly in a pistol equipped with a conventional commercially available magazine guide, a user is likely to put off servicing and cleaning of the main spring assembly. This can lead to a degradation of the main spring assembly components and increases the likelihood of malfunction in the main spring assembly.

A further problem with the commercially available plastic magazine guide is that it cannot be adjusted to accommodate different pistols. Even though the nominal dimensions of Colt Browning 1911 A-1 .45 caliber automatic pistols are highly standardized, there are dimensional variations within tolerances among individual pistols, particularly in the external dimensions of the outer structure of the pistol frame. There is no means for adjusting the commercially available plastic magazine guide for such variations among pistols. Consequently, the commercial guide tends to wobble on the butt of a pistol frame. This represents an annoyance, but more significantly detracts from the speed with which a magazine can be loaded into the magazine receiving opening in the pistol frame.

Other magazine loading aids have also been devised. One such conventional aid involves building up a bead at the bottom edge of the butt of the pistol frame to form a funnel-shaped guide or chute. However, this requires expert welding and is quite costly. Furthermore, it represents a permanent alteration to the pistol which a subsequent owner may not desire.

SUMMARY OF THE INVENTION

The present invention is an improved magazine loading aid for use with a pistol. The magazine loading aid is a guide having a base which seats against the butt of a pistol frame and which embraces the walls thereof adjacent the bottom edge of the pistol frame butt. The base defines a funnel into the magazine receiving opening in the butt of the pistol frame. The base also defines transverse openings on its opposite sides which are in coaxial alignment with magazine spring housing bores in the structure of the pistol frame. The magazine loading guide is also comprised of a mounting rod engaged with the base in the transverse openings. The mounting rod passes through the magazine spring housing pin receiving bores to secure the base of the guide to the pistol frame butt, and also to function as a magazine spring housing pin.

In the preferred form of the improved magazine loading guide of the invention the base of the guide extends around the entire circumference of the magazine receiving opening. The structure of the base is in direct contact with the pistol frame, but is not sandwiched between the wooden stocks on the sides of the pistol frame handle. Rather, the lower, marginal edges of the pistol frame stocks are trimmed so that the stocks reside in juxtaposition against the base of the magazine loading guide.

A unique feature of the improved magazine loading guide of the invention is the use of a mounting rod to serve both as a main spring housing pin retainer and as a means for securing the magazine loading guide to the pistol frame. This avoids any permanent attachment of the guide to the pistol frame, and also avoids attaching the guide by means of the stock bushings. As a consequence, the magazine loading guide of the invention can be removed from the pistol frame without ever removing the stocks. Accordingly, the magazine loading guide of the invention can be removed from the pistol frame in order to clean or service the main spring assembly without removing the stocks on the handle.

In a preferred form of the invention the base of the magazine loading guide extends around the entire circumference of the magazine receiving opening in the pistol frame. The base defines a funnel which includes sloping surfaces adjacent the front of the magazine loading opening, as well as the rear and the sides. This not only provides a more useful aid in directing the magazine into the magazine receiving opening in the pistol frame, but also provides a much stronger structure to the magazine loading guide.

A further feature of a preferred magazine loading guide according to the invention is the provision for adjustment to immobilize the guide relative to the pistol frame. In one preferred embodiment of the invention a tensioning screw is threadably engaged with the magazine guide base to bear laterally against the front wall of the pistol frame butt. The tensioning screw is generally aligned to exert a force directly toward the mounting rod. Preferably also, a second locking screw is threadably engaged with the mounting guide base to bear against the bottom of the pistol frame butt behind the mounting pin. The locking screw takes up any play and thoroughly immobilizes the magazine loading guide relative to the pistol frame.

Because the base of the magazine loading guide of the invention extends around the front of the pistol frame, a structure can be defined thereat to serve as a "memory" finger rest. That is, the front of the base can be formed to define a surface disposed concave upwardly. This surface aids in guiding the little finger of the user's firing hand into the same position each time the pistol is gripped. The user therefore tends to grip the pistol butt in exactly the same place every time the pistol is used.

A further preferred feature of the magazine guide of the invention is the provision of a luminescent target on the funnel in the guide base. This target is a small spot or dot on the funnel wall which is best visible when the user loads a magazine into the pistol while it is gripped in the user's firing hand. The luminescent spot glows in the dark so as to provide a target toward which the user directs the magazine to be loaded. This feature is particularly useful in night firing competition.

The invention may be described with greater clarity and particularity by reference to the accompanying drawings.

DESCRIPTION OF THE DRAWINGS

FIG. 1 is a side elevational view of a pistol frame equipped with a magazine loading aid according to the invention.

FIG. 2 is a sectional detail taken along the lines 2—2 of FIG. 1.

FIG. 3 is a bottom plan view of the embodiment of the magazine loading guide as employed in FIG. 1.

FIG. 4 is a sectional view taken along the lines 4—4 in FIG. 3.

FIG. 5 is a front elevational view showing the magazine loading guide of FIG. 3 in isolation.

FIG. 6 is a sectional plan view showing the base of the magazine loading guide in isolation with the tensioning screw removed, taken along the lines 6—6 in FIG. 1.

FIG. 7 is a sectional detail taken along the lines 7—7 of FIG. 3.

FIG. 8 is a sectional detail similar to FIG. 7 showing an alternative embodiment of the invention.

FIG. 9 is one perspective view of another alternative embodiment of the magazine loading guide of the invention.

FIG. 10 is a different perspective view of the magazine loading guide of FIG. 9.

FIG. 11 is a perspective view of yet another alternative embodiment of the magazine loading guide of the invention.

DESCRIPTION OF THE EMBODIMENTS

FIG. 1 illustrates a pistol frame 10 of a Colt Browning 1911 A-1 .45 caliber automatic pistol. The pistol frame 10 has a barrel rest 12, a trigger ring 14, and a butt or handle 16. The pistol frame butt 16 has upright walls 18 which terminate in lower edges 20, visible in FIG. 2. The lower edges 20 define a magazine receiving opening 22 in the butt of the pistol frame 10. The opening 22 is visible in cross section in FIG. 7.

An improved magazine loading guide 24 according to the invention has a base 26 shown seated against the butt 16 of the pistol frame 10 in FIGS. 1 through 4 and in FIG. 7. The base 26 embraces the lower extremities of the walls 18 and the lower edges 20 of the pistol butt 16. The base 26 defines a funnel having sloping surfaces 28, 30, 32 and 34 directed toward the magazine receiving opening 22, as best depicted in FIG. 3. The base 26 also defines transverse openings 36 and 38 aligned with each other on opposite sides of the base 26 as best depicted in FIG. 6. The openings 36 and 38 are coaxially aligned with magazine spring housing pin receiving bores in the opposite walls 18 of the pistol butt 16. The magazine loading guide 24 also includes a mounting rod 40 which is engaged with the base 26 in the transverse openings 36 and 38 and which passes through the magazine spring housing pin receiving bores, as best depicted in FIG. 2. The mounting rod 40 secures the base 26 to the pistol frame butt 16, and also functions as a magazine spring housing pin.

The butt 16 of the pistol frame 10 is depicted in detail in FIG. 4. The pistol butt 16 has parallel walls 18 which define a magazine cavity 42 configured to receive a pistol magazine. The magazine is inserted through the magazine receiving opening 22. Behind the magazine receiving cavity 42 the walls 18 of the pistol butt 16 define a channel 44 configured with grooves 46 adapted to receive corresponding ribs on the sides of a hard rubber main spring housing 48.

To insert the main spring housing 48 into the channel 44, the ribs on the main spring housing 48 are aligned with the grooves 46, and the main spring housing 48 is pushed up into the channel 44 from the bottom of the pistol butt 16. The main spring housing 48 may be removed by exerting a force downwardly thereon toward the bottom of the channel 44 until the ribs on the housing 48 are completely disengaged from the grooves 46. Insertion and removal of the main spring housing 48 can only be performed when the magazine loading guide 24 is removed from the pistol butt 16.

The main spring housing 48 includes a transverse bore which is coaxially aligned with corresponding bores in the walls 18 of the butt 16 of the pistol frame 10 and with the openings 36 and 38 in the base 26 when the magazine loading guide 24 is positioned on the pistol butt 16 as depicted in FIGS. 1 through 4. The main spring housing 48 also defines a longitudinal bore 50 parallel to the grooves 46.

The main spring housing 48 accommodates a main spring assembly within the bore 50. The main spring assembly has a plunger 52 having a relatively large disc-shaped head mounted on a downwardly extending shank. The shank of the hammer strut plunger 52 fits within the enclosure defined within a coil main spring 54 The lower end of the coil main spring 54 bears against a main spring housing retainer 56. The main spring housing retainer 56 has a conical downwardly pointing nose and an upwardly extending cylindrical shank. The shank of the main spring housing pin retainer fits within the lower end of the coil main spring 54.

In operation, the hammer strut plunger bears against a hammer strut (not shown) which is released by pulling the trigger of the pistol. When the hammer strut is released the coil main spring 54 operates the hammer strut to drive the hammer forward to strike the percussion cap in a round of ammunition. With the recoil of the pistol the coil main spring 54 is compressed and is not released again until the trigger is again pulled.

In a conventional Colt Browning 1911 A-1 .45 caliber pistol, the lower end of the coil main spring 54 is immobilized by the main spring housing pin retainer 56 which in turn bears against a transverse main spring housing pin, the ends of which are secured in the transverse openings in the pistol frame walls 18. According to the present invention, however, the conventinal main spring housing pin is removed and the mounting rod 40 is substituted in its place. A mounting rod 40 is a rod of cylindrical cross section that extends transversly and is no greater in length than the width of the base 26. The ends of the mounting rod 40 terminate within the openings 36 and 38, as depicted in FIG. 2.

As illustrated in FIG. 2, a neck 58 is defined at the center of the mounting rod 40. The neck 58 serves as a detent to receive the main spring housing pin retainer 56. The main spring housing pin retainer 56 engages the neck 58 of the mounting rod 40 to retard transverse displacement of the mounting rod 40.

By employing the mounting rod 40 to secure the base 26 to the pistol butt 16, any interconnection between the magazine guide 24 and the bushings for the stock screws 60 holding the stocks 62 on the pistol butt 16 is avoided. The magazine loading guide 24 can therefore be removed from the pistol butt 16 without removing the stocks 62. The lower edges of conventional stocks 62 must be trimmed slightly before the guide 24 is first secured to the pistol butt 16, but thereafter there is no need to remove the stocks 62 in order to remove the magazine loading guide 24. Rather, the stocks 62 reside in abutment against the upper edges of the base 26, as best illustrated in FIG. 2.

In a pistol frame 10 equipped with the magazine guide 24 of the invention, the main spring housing 48 can be readily removed without disturbing the stocks 62. To remove the main spring housing 48 the transverse mounting rod 40 is first axially forced in a transverse direction to overcome the bias on the main spring housing pin retainer 56 exerted by the coil main spring 54. The mounting rod 40 is then forced beyond the structure of the pistol frame 10, thus releasing the magazine loading guide 24 from the butt 16 of the pistol frame 10. With the magazine loading guide 24 removed, the main spring housing 48 can be readily forced downwardly for disengagement from the grooves 46 defined on the interior walls 18 of the channel 44. During reinstallation of the main spring housing 48 and the magazine loading guide 24, the process is reversed.

In the embodiment of the invention depicted in FIGS. 1–4, the front of the base 26 defines a surface 64 facing concave upwardly. The surface 64 forms a finger rest to aid in positioning a user's grip on the pistol frame butt 16. That is, the surface 64 serves as a seat or memory rest which aids a user in gripping the pistol butt 16 in the same way each time the pistol handle is seized by the firing hand of the user. It is generally recognized that a consistency in gripping a pistol aids in achieving a consistency of grouping shots which are fired.

Unlike prior devices which are often of U-shaped configuration, the magazine loading guide 24 completely surrounds the magazine receiving opening 22 at the front as well as the sides thereof. The base 26 thereby provides structure at the front of the pistol butt 16 which is used to define the memory grip or finger rest 64.

A further feature of the magazine guide 24 is that with the structure of the base 26, a funnel is defined by the sloping surfaces 28, 30, 32 and 34 to completely surround the magazine opening 22 in the pistol butt 16. A magazine pushed into the magazine receiving opening 22 in a slight forward misalignment therewith is therefore deflected into the magazine receiving opening 22 by the sloping surface 34. Prior magazine loading guides fail to provide any remedy for such a slight, forward misalignment.

Another advantage of the magazine loading guide 24 depicted in FIGS. 1–4 is the high strength, sturdiness and durability which it offers in contrast to the conventional, generally U-shaped magazine guides. By forming a complete encircling structure, as best depicted in FIGS. 3 and 6, the magazine guide 24 has a degree of rigidity unmatched by prior removable magazine loading guides.

The magazine loading 24 is also provided with adjustment means so that the magazine loading guide 24 may accommodate variations in tolerances of different pistols of the same model, and even accommodate different models of pistols. The magazine loading guide 24 includes a tensioning screw 66, shown removed from the base 26 in FIG. 6. The tensioning screw 66 is externally threaded and is engaged with a corresponding tapped bore 68 in the front of the base 26. The tensioning screw 66 is advanced and withdrawn by means of a hexagonal recess in its head, depicted in FIG. 5, designed to receive an allen head wrench.

FIG. 4 illustrates the tensioning screw 66 disposed in the tapped bore 68 and threadably engaged with the base 26 to bear laterally against the wall 18 at the front of the pistol frame butt 16. Preferably, the axis of alignment of the bore 68 is disposed to intersect the axis of alignment of the openings 36 and 38 so that the force of tension exerted by the tensioning screw 66 acts through the center of the mounting rod 40 without any torsional component. The tensioning screw 66 is thereby interposed between the base 26 and the butt 16 of the pistol frame 10 to push on the base 26 against the pistol frame 10.

The magazine loading guide 24 is also provided with a locking screw 70 which is similar in construction to the tensioning screw 66. The locking screw 70 is illustrated in FIGS. 3, 4, and 6. The locking screw 70 is engaged in a tapped bore in the base 26 to exert a force on the pistol frame butt 16 at a different angle than the tensioning screw 66. The locking screw 70 exerts a force on the pistol frame 10 through the main spring housing 48, as illustrated in FIG. 4. The locking screw 70 exerts a force against the pistol frame behind the mounting rod 40. The locking screw 70 thereby prevents the base 26 from rocking or wobbling against the lower edges 20 of the pistol butt 16.

The magazine loading guide 24 defines a flat bearing surface 72 which resides in abutting contact against the lower edges 20 of the walls 18 of the pistol butt 16. The bearing surface 72 has an expansive portion at its rear which resides in contact with the lower edges 20 of the interior wall 18 and the walls 18 defining the channel 44 at the rear of the pistol butt 16. The bottom of the main spring housing 48 also bears against the expansive portion of the bearing surface 72 of the base 26. The bearing surface 72 also has forwardly extending bearing ledges 74 defined on both sides at the interior walls of the base 26.

In the embodiment of the invention depicted in FIGS. 1–7, the base 26 is configured so that the width of the bearing ledges 74 is thick enough to overhang only a portion of the bottom edge 20 of the walls 18 defining the magazine receiving opening 22 in the pistol butt 16. The interior corners of the lower edges 20 are chamfered, preferably at an angle of 45°, so as to define a continuation of the funnel formed by the sloping surfaces 28, 30, 32 and 34, as best depicted in FIG. 7.

In an alternative embodiment of the invention depicted at 24' in FIG. 8, the bearing ledges 74' are thicker in width so as to overhang the entire surface of the bottom edges 20 of the walls 18 of the pistol frame butt 16 defining the magazine receiving opening 22. The overall funneling or guiding surfaces defined on the base 26 and by the chamfered edges 20 in the embodiment of FIGS. 1–7 is greater than that of FIG. 8. However, with the embodiment of FIG. 8 no alteration is required to the lower edges 20 of the walls 18 of the pistol butt 16.

FIGS. 9 and 10 illustrate an alternative embodiment of the magazine loading guide of the invention. The magazine loading guide 124, depicted therein, includes a base 126. Like the base 26, the base 126 is configured to seat against the butt 16 of the pistol frame 10 both fore and aft of the transverse main spring housing pin bores through the walls 18 of the pistol frame 10. Also, the base 126 includes inclined surfaces 128, 130, 132 and 134, depicted in FIG. 10, to define a funnel or chute into the magazine receiving opening 22 in the pistol frame butt 16. The base 126 also defines transverse openings 136 and 138 which are aligned with the main spring housing pin bores through the walls 18. The base 126 does not, however, include any surface defining a memory finger rest. In all other respects the magazine loading guide 124 is identical to the magazine loading guide 24.

FIG. 11 illustrates another embodiment of the magazine loading guide of the invention, indicated at 224. Unlike the magazine loading guides 24 and 124, the magazine loading guide 224 is a U-shaped structure having legs 225 and 227 and a back 229. The legs 225 and 227 and the back 229 define a chute with inwardly facing guiding surfaces 228, 230 and 232. The surfaces 228, 230 and 232 converge toward the magazine receiving opening 22 in the pistol frame butt 16. As with the other embodiments of the magazine funnel guide, a mounting rod 40 passes through transverse apertures 236 and 238. The mounting rod 40 is thereby able to serve as the main spring housing pin. As in the other embodiments the bearing surfaces (not visible) which reside in contact with the bottom edges 20 of the walls 18 and with the bottom of the main spring housing 48 prevent the guide 224 from rotating on the mounting rod 40 relative to the pistol frame 10.

The magazine loading guide 224 has a further unique feature in the form of a luminescent target 239 on the sloping surface 232 of the base 226. The luminescent target 239 includes a red dot 240 at its center, surrounded by an annular, pale green luminescent ring 242. The luminescent target 239 may be formed of a luminescent paint, or it may be a plastic insert containing a luminescent material such as radium.

Because the magazine loading guide 224 does not completely surround the magazine receiving opening 22, it will not correct a slight forward misalignment of a magazine being inserted into the magazine receiving opening 22. Also, because it is of a U-shaped configuration like the conventional commercially available magazine loading guide, it lacks the structural sturdiness of the magazine loading guides 24 and 124. If the magazine loading guide 224 is formed of a cast structure, the legs 225 and 227 may tend to spread out as the casting cools. However, as with the other embodiments the magazine loading guide 224 is secured to the pistol frame 10 by means of a mounting rod 40 which also serves as the main spring housing pin. Accordingly, with the magazine loading guide 224 the main spring housing 48 can be removed without removing the stocks 62 on the butt 16 of the pistol frame 10.

Undoubtedly numerous other variations and modifications of the invention are possible and will become readily apparent to those familiar with firearms. Accordingly, the scope of the invention should not be construed as limited to the specific embodiments depicted and described, but rather is defined in the claims appended hereto.

I claim:

1. An improved magazine loading aid for use with a pistol comprising a base which seats against the butt of a pistol frame and which embraces the walls thereof and which defines a funnel with a magazine receiving opening in said butt of said pistol frame, and which defines transverse openings on opposite sides thereof in coaxial alignment with magazine spring housing pin receiving means in said pistol frame, and a mounting rod engaged with said base in said transverse openings, and passing through said magazine spring housing pin receiving means to secure said base to said pistol frame butt and to function as a magazine spring housing pin.

2. A magazine loading aid according to claim 1 further characterized in that said funnel extends around the entire circumference of said magazine receiving opening.

3. A magazine loading aid according to claim 1 further characterized in that a neck is defined on said mounting rod to engage a main spring housing pin retainer and to retard transverse displacement of said mounting pin.

4. A magazine loading aid according to claim 1 further comprising a tensioning screw threadably engaged with said base to bear laterally against the front of said pistol frame butt.

5. A magazine loading aid according to claim 4 further comprising a locking screw threadably engaged with said base to exert a force against the said pistol frame butt behind said mounting rod.

6. A magazine loading aid according to claim 1 in which said base further defines a finger rest to guide a user's grip on the pistol butt.

7. A magazine loading aid according to claim 1 in which said funnel overhangs the entire surface of the bottom edge of said pistol frame butt defining said magazine receiving opening.

8. A magazine loading aid according to claim 1 in which said funnel overhangs only a portion of the bottom edge of said pistol frame butt defining said magazine receiving opening.

9. An improved magazine loading guide for a pistol comprising a base which seats against the butt of a pistol frame both fore and aft of transverse main spring housing pin bore means through said pistol frame, said base defining a funnel into a magazine receiving opening in said pistol frame butt and transverse openings aligned with said main spring housing pin bore means, and a mounting rod which passes through said main spring housing pin bore means and into said transverse openings in said base aligned therewith to secure said base to said pistol frame and to serve as a main spring housing pin.

10. A magazine loading guide according to claim 9 further comprising tensioning means interposed between said base and said pistol frame to push on said base against said pistol frame.

11. A magazine loading guide according to claim 10 in which said tensioning means is a tensioning screw threadably engaged with said base to bear against said pistol frame.

12. An improved magazine loading guide according to claim 9 in which said funnel completely surrounds said magazine receiving opening.

13. An improved magazine loading guide according to claim 10 further comprising a tensioning screw which is engaged in said base to bear against the front of said pistol frame butt.

14. An improved magazine loading guide according to claim 13 further comprising a locking screw engaged in said base to exert a force on said pistol frame butt at a different angle than said tensioning screw.

15. An improved magazine loading guide according to claim 9 in which said base forms a finger rest to aid in positioning a user's grip on said pistol frame butt.

16. An improved magazine loading guide according to claim 9 further comprising a luminescent target on said funnel in said base.

17. An improved magazine loading guide according to claim 9 in which said mounting rod defines a detent to receive a main spring housing pin retainer so as to position said mounting rod in said main spring housing pin bore means.

18. An improved magazine funnel for a pistol comprising a guide which embraces the butt of a pistol frame and which defines a chute with inwardly facing guiding surfaces that converge toward a magazine receiving opening in said pistol frame butt, a mounting rod which passes through said guide and which also serves as the main spring housing pin, and means for preventing said guide from rotating on said mounting rod relative to said pistol frame.

* * * * *